US009631409B2

(12) United States Patent
Wang et al.

(10) Patent No.: US 9,631,409 B2
(45) Date of Patent: Apr. 25, 2017

(54) INTERACTIVE SLIDING-DOOR DEVICE

(71) Applicant: WEIDER METAL INC., New Taipei (TW)

(72) Inventors: Grace Show-Yin Wang, New Taipei (TW); Jennifer Wu, New Taipei (TW); Andy Wu, New Taipei (TW); Jacquelin Wu, New Taipei (TW)

(73) Assignee: Weider Metal Inc., New Taipei (TW)

( * ) Notice: Subject to any disclaimer, the term of this patent is extended or adjusted under 35 U.S.C. 154(b) by 0 days.

(21) Appl. No.: 14/937,932

(22) Filed: Nov. 11, 2015

(65) Prior Publication Data

US 2016/0230437 A1 Aug. 11, 2016

(30) Foreign Application Priority Data

Feb. 10, 2015 (TW) ..... 104202120 U

(51) Int. Cl.
*E06B 9/06* (2006.01)
*E05D 15/06* (2006.01)
(Continued)

(52) U.S. Cl.
CPC ..... *E05D 15/0652* (2013.01); *E05D 15/0639* (2013.01); *E05D 15/08* (2013.01); *E05F 17/00* (2013.01); *E05F 2017/005* (2013.01); *E05F 2017/007* (2013.01); *E05Y 2201/224* (2013.01); *E05Y 2201/654* (2013.01); *E05Y 2900/132* (2013.01); *E05Y 2900/142* (2013.01)

(58) Field of Classification Search
CPC . E06B 9/0653; E06B 9/0676; E05D 15/0652; E05D 15/0643; E05D 15/0621; E05D 15/12
USPC ..... 160/197, 202, 177 V, 178.1 V, 345, 199
See application file for complete search history.

(56) References Cited

U.S. PATENT DOCUMENTS 1,960,860 A * 5/1934 Allen ..... E05F 17/00 160/184
2,895,183 A * 7/1959 Dumbolton ..... E05D 15/08 160/197
(Continued)

FOREIGN PATENT DOCUMENTS

CN 2422415 Y 3/2001
CN 201865508 U 6/2011
(Continued)

*Primary Examiner* — David Purol
(74) *Attorney, Agent, or Firm* — Rosenberg, Klein & Lee

(57) ABSTRACT

An interactive sliding-door device has a track assembly, a door assembly, and an interacting assembly. The track assembly is mounted on a top end of an inner space of a building, and has multiple elongated members disposed side by side. The door assembly has multiple boards mounted in the elongated members respectively. Each of the boards has two wheel assemblies, and the wheel assemblies are slideable relative to the elongated members. Therefore, the boards can slide in two ways, and are unrestrained from a construction layout of the building. The wheel assembly is adjustable according to a height of the board. The interacting assembly may be mounted on the board directly or by two mounting assemblies. The interacting assembly has two clamps, two positioning wheels and a cord. The cord is mounted in the positioning wheels and clamped by the clamps and then the boards can slide interactively and stably.

12 Claims, 10 Drawing Sheets

(51) Int. Cl.
*E05F 17/00* (2006.01)
*E05D 15/08* (2006.01)

(56) References Cited

U.S. PATENT DOCUMENTS 3,389,741 A * 6/1968 Bean ..... E06B 3/481 160/199
3,911,991 A * 10/1975 Malferrari ..... A47H 1/04 160/197
4,852,300 A * 8/1989 Keast ..... E05F 15/643 49/102
4,998,577 A * 3/1991 Kobayashi ..... E05D 15/0608 160/197
5,109,910 A * 5/1992 Tortorella ..... A47H 15/04 160/197
5,947,178 A * 9/1999 Patten ..... E04H 4/088 160/193
6,052,867 A * 4/2000 Haab ..... E05D 15/063 16/87 R
6,438,795 B1 * 8/2002 Haab ..... E05D 13/04 16/85
6,516,575 B2 * 2/2003 Haab ..... E05D 13/04 160/196.1
6,892,783 B1 * 5/2005 Comeau ..... A47H 1/08 160/126
7,174,944 B1 * 2/2007 Clark ..... E05D 15/063 16/96 R
7,987,891 B2 * 8/2011 Zhou ..... A47K 3/34 160/185
8,579,006 B2 * 11/2013 Levin ..... E04B 2/827 160/184
2010/0281776 A1 11/2010 Tarrega Lloret

FOREIGN PATENT DOCUMENTS

CN 103806801 A 5/2014
CN 203783367 U 8/2014
JP 10-61322 A 3/1998
KR 10-1182413 B1 9/2012

* cited by examiner

INTERACTIVE SLIDING-DOOR DEVICE

BACKGROUND OF THE INVENTION

1. Field of the Invention

The present invention relates to a sliding door, and more particularly to a sliding door device that is operated in one way or two ways and slides interactively.

2. Description of the Related Art

A sliding door is mounted inside a building. When an inner space of a building is not constructed to have multiple compartments, the inner space can be divided into multiple compartments by mounting sliding doors. Users may pull or push a door board of the sliding door to extend or to retract the sliding door. Therefore, the inner space of the building can be divided into multiple compartments conveniently and flexibly.

With reference to FIG. 9, a conventional sliding door is mounted in an inner space of a building that has multiple inner walls 70 and two tracks 90. One of the inner walls 70 has an extending part 71. The extending part 71 has a first positioning block 711. The first positioning block 711 is mounted in one of two sides of the extending part 71, and is mounted in one end distal from the inner wall 70. The tracks 90 may be mounted in a top end of the inner space of the building or a bottom end of the inner space.

The conventional sliding door has a door assembly 80. The door assembly 80 has a first board 81 and a second board 82.

The first board 81 is mounted slidably in one of two tracks 90, and has a second positioning block 811, a third positioning block 812 and an abutting block 813.

The second positioning block 811 and the third positioning block 812 are mounted respectively in two side surfaces of the first board 81, and are located respectively in two ends. The second positioning block 811 corresponds to the first positioning block 711 of the extending part 71. The abutting block 813 is mounted in the end in which the second positioning block 811 is mounted and corresponds in position to the third positioning block 812.

The second board 82 has a fourth positioning block 821. The fourth positioning block 821 is mounted on one of two side surfaces of the second board 82. The fourth positioning block 821 corresponds in position to the third positioning block 812. The second board 82 is mounted slidably in the other track 90.

When the user pulls the second board 82, the inner space of the building is divided into multiple compartments by extending the sliding door. As the second board 82 slides in the track 90, the fourth positioning block 821 abuts the third positioning block 812. And then the first board 81 is pushed forward to slide. The first board 81 keeps sliding until the second positioning block 811 abuts the first positioning block 711 of the extending part 71. Therefore, the sliding door fully extends to divide the inner space into compartments.

With reference to FIG. 10, when the user pushes the second board 82 towards the extending part 71 to retract the sliding door, the fourth positioning block 821 moves towards the abutting block 813 and away from the third positioning block 812. Therefore the first board 81 is retracted towards the inner wall 70 as the second board 82 slides on the track 90.

However, because the conventional sliding door is mounted in the extending part 71 of the inner wall 70, the user merely pulls or pushes the second board 82 to extend or retract the conventional sliding door in one way. Furthermore, as the user pulls or pushes the door assembly 80, the first board 81 and the second board 82 are respectively sliding on the tracks 90. A first gap 801 is formed between the first positioning block 711 and the second positioning block 811. A second gap 802 is formed between the third positioning block 812 and the fourth block 821. Thus, the first board 81 does not slide interactively and stably with the second board 82 when the door assembly 80 extends or is retracted. Besides, collisions of the aforementioned positioning blocks cause knocking noise.

SUMMARY OF THE INVENTION

An objective of the present invention is to provide an interactive sliding-door device that slides interactively and stably and eliminates knocking noise.

To achieve the foregoing objective, the interactive sliding-door device is mounted in an inner space of a building and comprises a track assembly, a door assembly, and an interacting assembly. The track assembly has multiple elongated members that are mounted on a top end of the inner space of the building, and multiple positioning blocks that are mounted in pairs in both of two ends of an inside wall of each of the elongated members. The door assembly has multiple boards that are mounted in the track assembly and corresponding to the elongated members in position respectively. The board has multiple wheel assemblies. Each two of the wheel assemblies are mounted on a top end surface of the board. The wheel assembly is mounted inside and abuts the elongated member. The wheel assembly is detachably mounted in the positioning blocks. The interactive assembly is mounted in the top end surface of the board of the door assembly, and is attached to the boards. The boards of the door assembly are kept interactively sliding by the interacting assembly.

Other objectives, advantages and novel features of the invention will become more apparent from the following detailed description when taken in conjunction with the accompanying drawings.

DETAILED DESCRIPTION OF THE INVENTION

Figure 1:
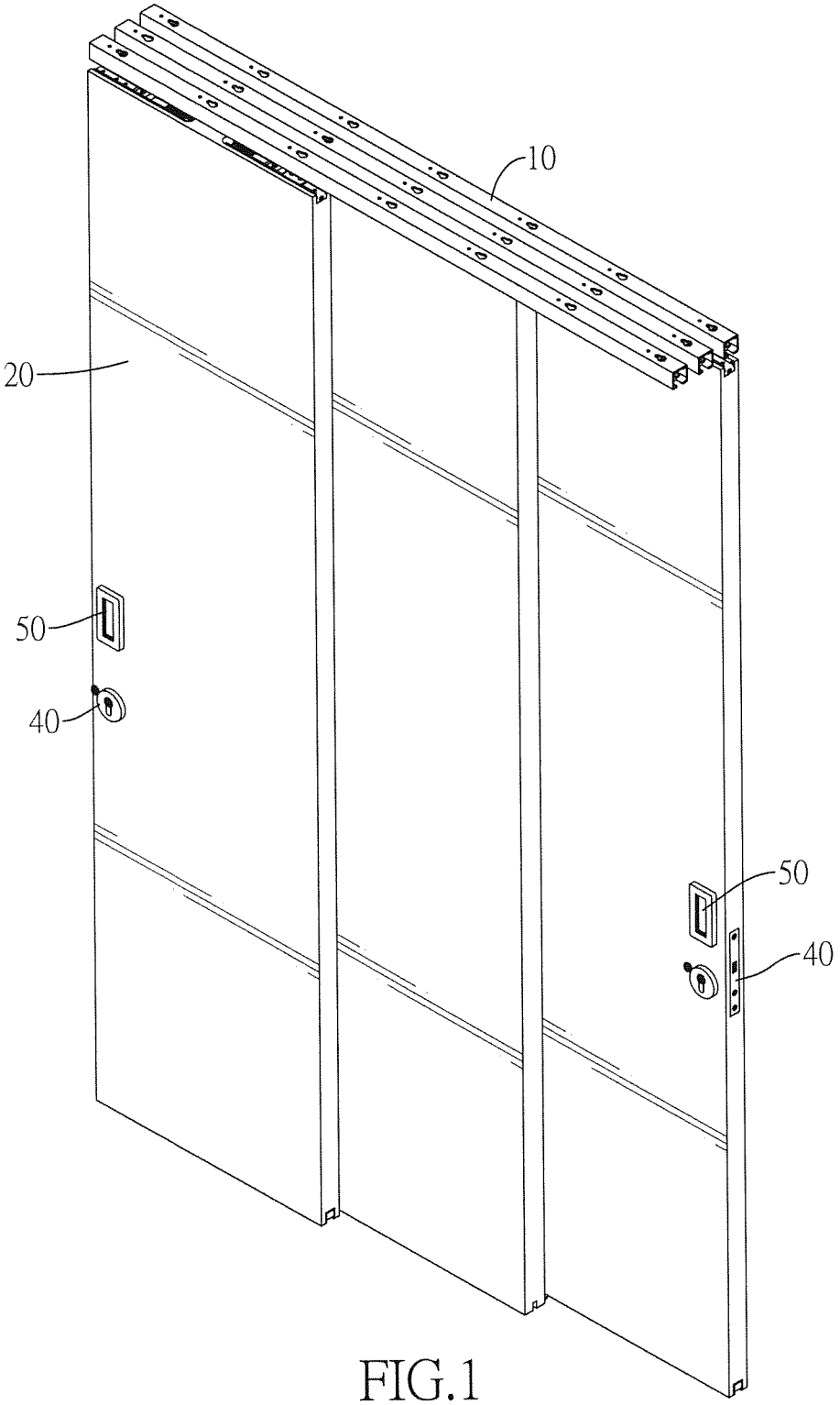
FIG. 1 is a perspective view of an interactive sliding-door device in accordance with the present invention.
Figure 6:
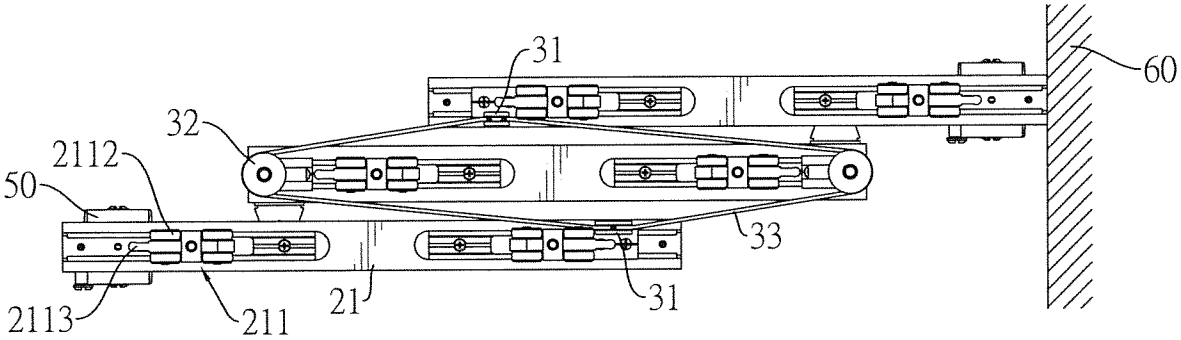
FIG. 6 is an operational top view of the interactive sliding-door device in FIG. 3, showing that the interactive sliding-door device is retracted.

With reference to FIG. 1, an interactive sliding-door device in accordance with the present invention is mounted in an inner space of a building, and comprises a track assembly 10, a door assembly 20, an interacting assembly 30, two door locks 40, and two pairs of door handles 50. With reference to FIG. 6, the inner space that is to be divided into multiple compartments has at least one retaining element 60.

Figure 2:
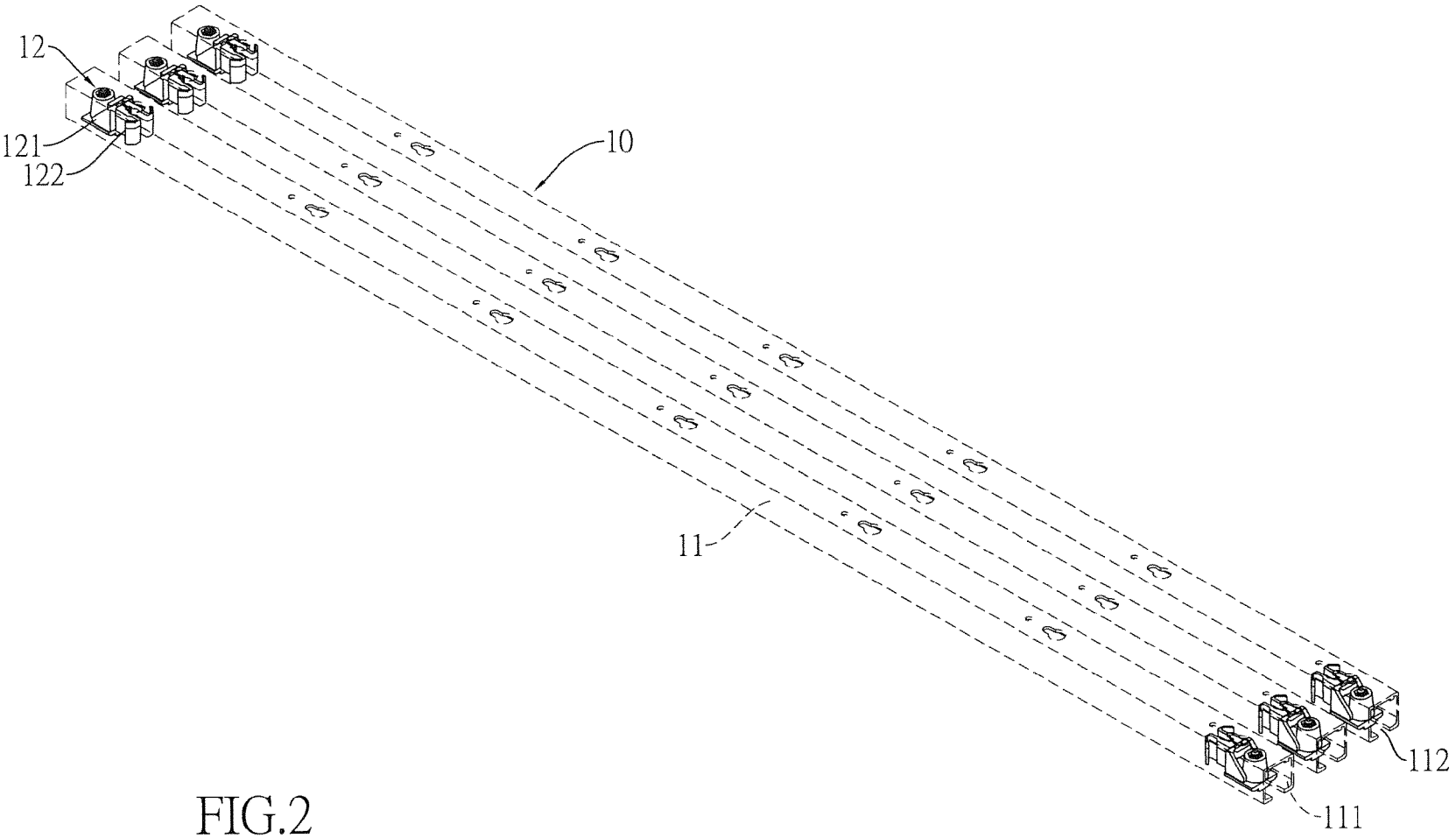
FIG. 2 is a perspective view of a track assembly of the interactive sliding-door device in FIG. 1.

With reference to FIG. 2, the track assembly 10 has multiple elongated members 11 and multiple positioning blocks 12. In a preferred embodiment of the present invention, the track assembly 10 may have three elongated members 11 that are disposed side by side, and are mounted on a top end of the inner space of the building, and an amount of the positioning blocks 12 is six. Two of the three elongated members 11 are disposed on the two outer sides of the track assembly 10. The other elongated member 11 is disposed on a middle portion of the track assembly 10.

Each of the elongated members 11 has two sliding parts 111 and a slot 112.

The sliding part 111 is formed on a bottom surface of the elongated member 11. Specifically, the elongated member 11 is manufactured by bending a thin plate. The two sliding parts 111 are disposed opposite each other.

The slot 112 is defined between the two sliding parts 111 in a longitudinal direction of the elongated member 11.

The positioning blocks 12 are arranged in pairs that correspond to the elongated members 11. The positioning blocks 12 of each pair are mounted respectively in two ends of an inside wall of a corresponding elongated member 11.

Each positioning block 12 has an attaching seat 121 and a holding part 122.

The attaching seat 121 is mounted in an end of the elongated member 11.

One of two ends of the holding part 122 attaches to the attaching seat 121. The other end of the holding part 122 extends away from the attaching seat 121. Specifically, the holding part 122 is an elastic member, and said the other end of the holding part 122 is U-shaped.

With reference to FIGS. 1 and 2, the door assembly 20 is mounted slidably in the track assembly 10 and has multiple boards 21.

In a preferred embodiment of the present invention, the door assembly 20 has three boards 21 that are disposed side by side. Two of the three boards 21 are disposed respectively on two outer sides of the door assembly 20. The other board 21 is disposed on a middle portion of the door assembly 20. The boards 21 correspond in position to the elongated members 11. The three boards 21 correspond to and are mounted respectively in the three elongated members 11. In a preferred embodiment of the present invention, the boards 21 are metallic or wooden door boards. Each board 21 has two wheel assemblies 211.

Each wheel assembly 211 is mounted slidably inside the elongated member 11 and has a base part 2111 and two pairs of rollers 2112. Specifically, each wheel assembly 211 further has a bolt 2110. Each wheel assembly 211 is mounted on a top end surface of the board 21 by a bolt 2110. The bolt 2110 is mounted through the slot 112 of the elongated member 11 and is mounted on the base part 2111.

The base part 2111 is mounted on the top end surface of the board 21 and has a protruding part 2113. The protruding part 2113 is formed on and protrudes from one of two ends of the base part 2111. The protruding parts 2113 of the wheel assemblies 211 on each board 21 extend away from each other. The protruding part 2113 is detachably mounted in the U-shaped end of the holding part 122 of the positioning block 12.

The two pairs of the rollers 2112 are mounted respectively in two side surfaces of the base part 2111. The rollers 2112 of each pair are spaced apart at an interval. Each roller 2112 is mounted on the sliding part 111 of the elongated member 11.

Figure 3:
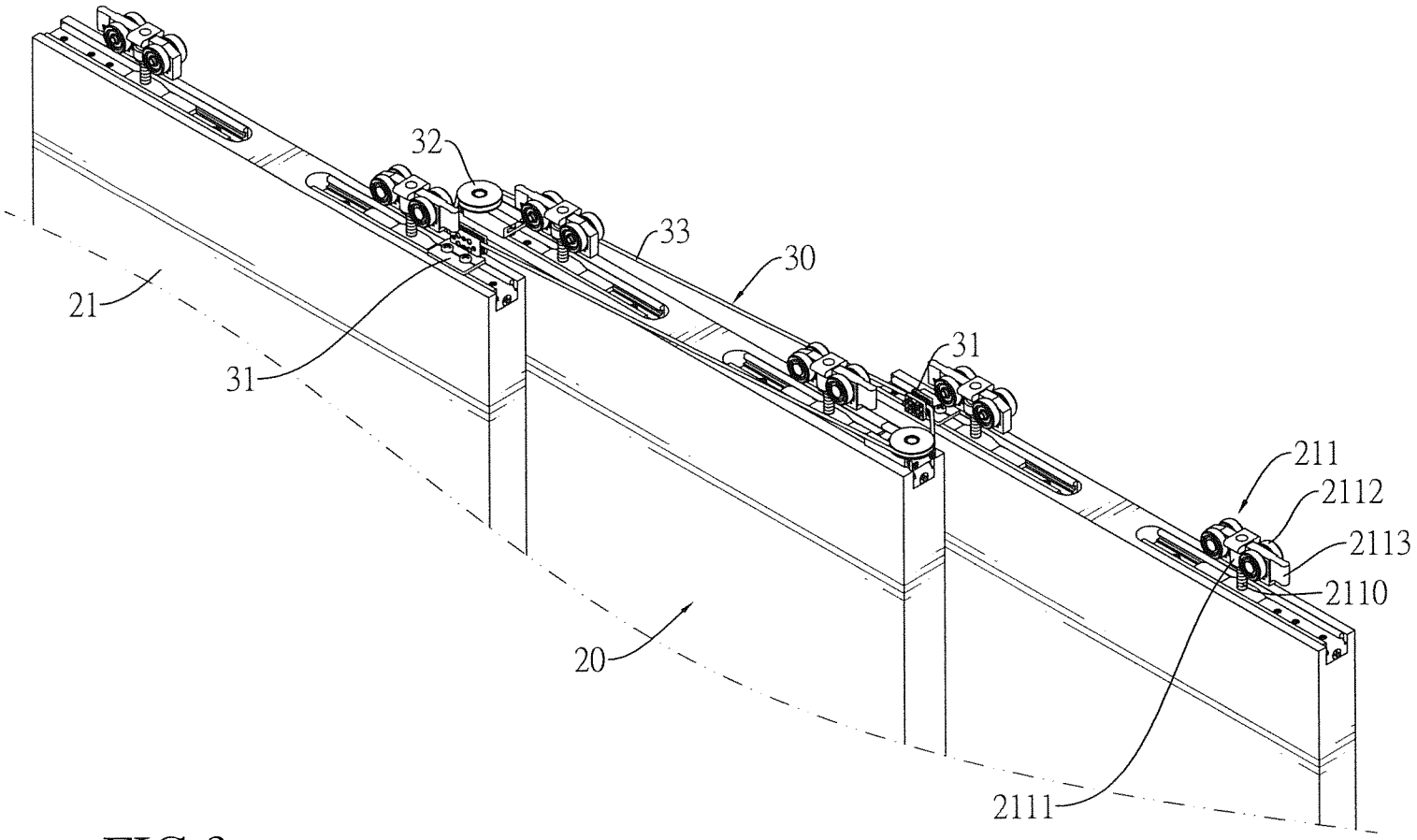
FIG. 3 is an enlarged perspective view of an interacting assembly of the interactive sliding-door device in FIG. 1.
Figure 4:
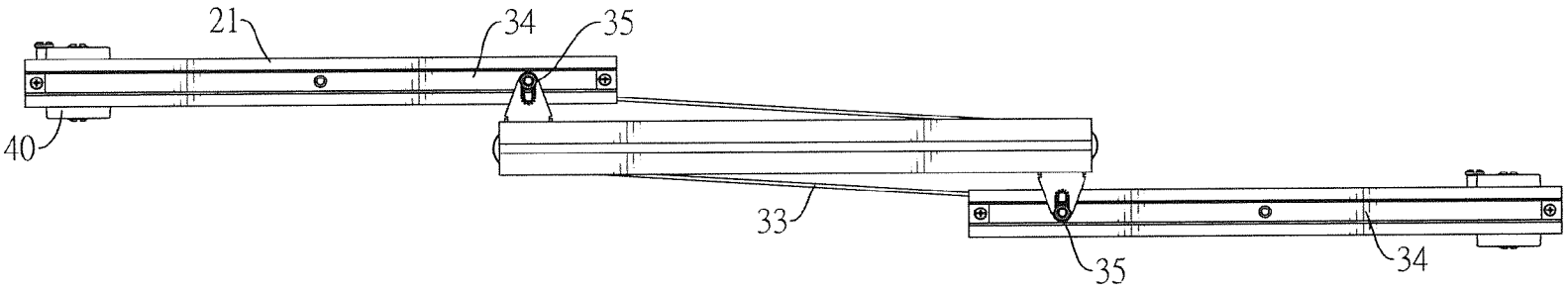
FIG. 4 is a bottom view of the interactive sliding-door device in FIG. 1.

The interacting assembly 30 is mounted on a top end of the door assembly 20 and connects the boards 21 together such that sliding one board 21 also drives the other two boards 21 to slide. With reference to FIGS. 3 and 4, the interacting assembly 30 has two clamps 31, two positioning wheels 32 and a cord 33. In a preferred embodiment of the present invention, the interacting assembly 30 further has two sliding tracks 34 and two sliding blocks 35.

As shown in FIG. 3, the two clamps 31 are mounted respectively in the two boards 21 that are disposed on the two outer sides of the door assembly 20, and are mounted respectively in one end of each of the two boards 21.

The positioning wheels 32 are mounted respectively in two ends of the top end surface of the board 21 that is disposed on the middle portion of the door assembly 20. Each of the positioning wheels 32 has a groove. The groove is defined annually in an outer surface of the positioning wheel 32, and is parallel to the top end surface of the board 21.

The cord 33 is mounted in the grooves of the two positioning wheels 32, and is clamped by the two clamps 31. The cord 33 can be tighten by using an alien key, where the wheels 32 are located below the T structure and sloted within U structure. By rotating the screws within the T structure, it would push the U structure away and therefore tightening the cord 33.

As shown in FIG. 4, the two sliding tracks 34 are mounted respectively in a bottom end surface of each of the two boards 21 that are disposed on the two outer sides of the door assembly 20.

The two sliding blocks 35 are mounted respectively on two side surfaces of a bottom end of the board 21 disposed on the middle portion of the door assembly 20, and are attached respectively to the two sliding tracks 34 that are mounted in the two boards 21 disposed on the outer sides of the door assembly 20.

As shown in FIG. 1, the two door locks 40 are mounted respectively in an outer edge of each of the two boards 21 that are disposed on the two outer sides of the door assembly 20. The door lock 40 is detachably connected to the at least one retaining element 60.

Figure 5:
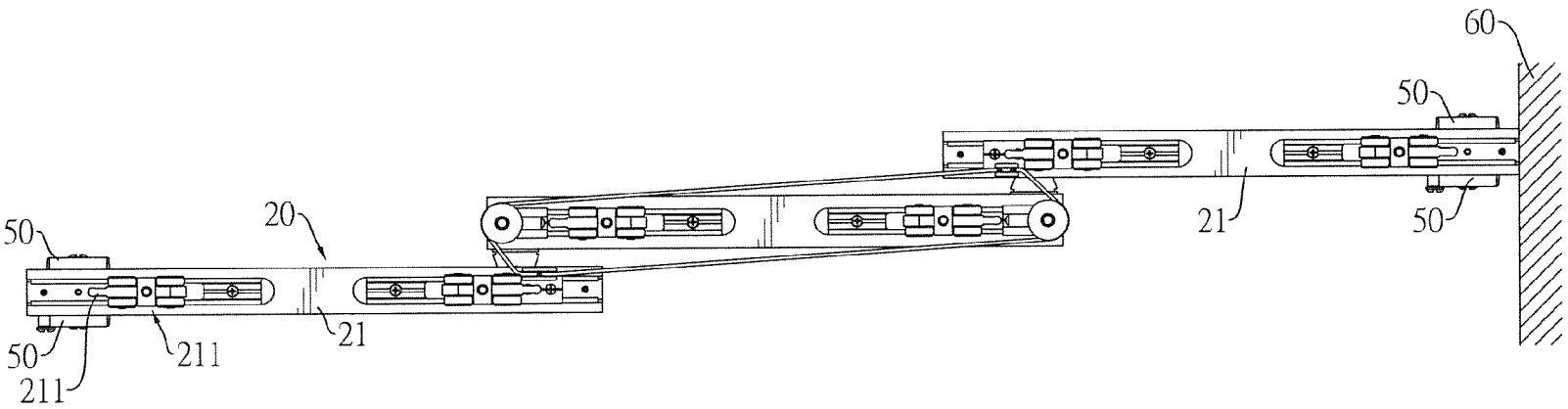
FIG. 5 is a top view of the interactive sliding-door device in FIG. 3, showing that the interactive sliding-door device is extended.

With reference to FIG. 5, the two pairs of door handles 50 are mounted respectively on two side surfaces of the two boards 21 that are disposed on the two outer sides of the door assembly 20.

The at least one retaining element 60 is mounted on one inner wall of the building. Specifically, the at least one retaining element 60 may be two in amount, and the retaining elements 60 are mounted respectively in two inner walls of the building.

As shown in FIG. 5, when the interactive sliding-door device in accordance with the present invention is extended, an inner space of the building is partitioned to multiple compartments. As shown in FIGS. 2 and 3, the protruding parts 2113 of the wheel assemblies 211 correspond detachably to the U-shaped ends of the holding parts 122. Thus, the track assembly 10 positions the door assembly 20. The positioning block 12 stops the board 21 from sliding. One of the two retaining elements 60 may lock or unlock the door lock 40. Besides, the interactive sliding-door device may lock or unlock the other retaining element 60 of the other inner wall of the building by detachably connecting to the other door lock 40.

As shown in FIGS. 2 and 6, when the user pushes the door handle 50 that is mounted on the board 21 and extends away from the retaining element 60 to retract the door assembly 20, the wheel assembly 211 of the board 21 that is away from the retaining element 60 is detached from the holding part 122 of the positioning block 12 to release the positioning between the board 21 and the positioning block 12. And then, the board 21 that is pushed moves towards the retaining element 60.

Because the boards 21 of the door assembly 20 slide relative to the track assembly 10, the boards 21 can be pulled or pushed in either one way or two ways. Therefore, the present invention eliminates restriction of one-way operation of the conventional sliding door limited by an inner construction layout of the building. Because the wheel assemblies 211 of the boards 21 respectively slide on the sliding parts 111 of the elongated members 11, the door assembly 20 slides relative to the track assembly 10. Meanwhile, the wheel assemblies 211 are detachably connected to the positioning blocks 12, thus the boards 21 are positioned in the elongated members 11 to prevent the board 21 from unintentional sliding. Besides, because the bolt 2110 is mounted in the base part 2111 by threading, the wheel assembly 211 can be adjusted upwards or downwards depending on a height of the board 21 by rotating the bolt 2110 relative to the wheel assembly 211.

The boards 21 of the door assembly 20 are pushed or pulled interactively in either one way or two ways according to the users' operation. The boards 21 can be gathered to a position of the inner space of the building, and then the user pushes the boards 21 interactively to slide each side of the track assembly 10. Therefore, users can operate the present invention flexibly, and have the inner space partitioned conveniently. And the present invention can be mounted in door boards of any material according to users' choice, such as wooden board, iron board, glass board, or aluminum board.

Because of an attachment among the clamp 31, the positioning wheel 32, and the cord 33 of the interacting assembly 30, the boards 21 of the door assembly 20 are sliding interactively. Thus, when one of the boards 21 slides, the other boards 21 slide interactively. Therefore, the interactive sliding avoids distances or gaps formed among the boards 21.

Because the sliding track 34 and the sliding block 35 are attached to the bottom end of the door assembly 20, the boards 21 are sliding stably when the door assembly 20 slides relative to the track assembly 10. Therefore, the boards 21 can avoid suspending, and do not collide with each other in sliding.

Due to locking of the door lock 40, either one of the boards 21 on the two outer sides of the door assembly 20 detachably connects the retaining element 60 of the inner wall of the building. Therefore, the board 21 of the outer sides of the door assembly 20 is fixed temporarily.

Figure 7:
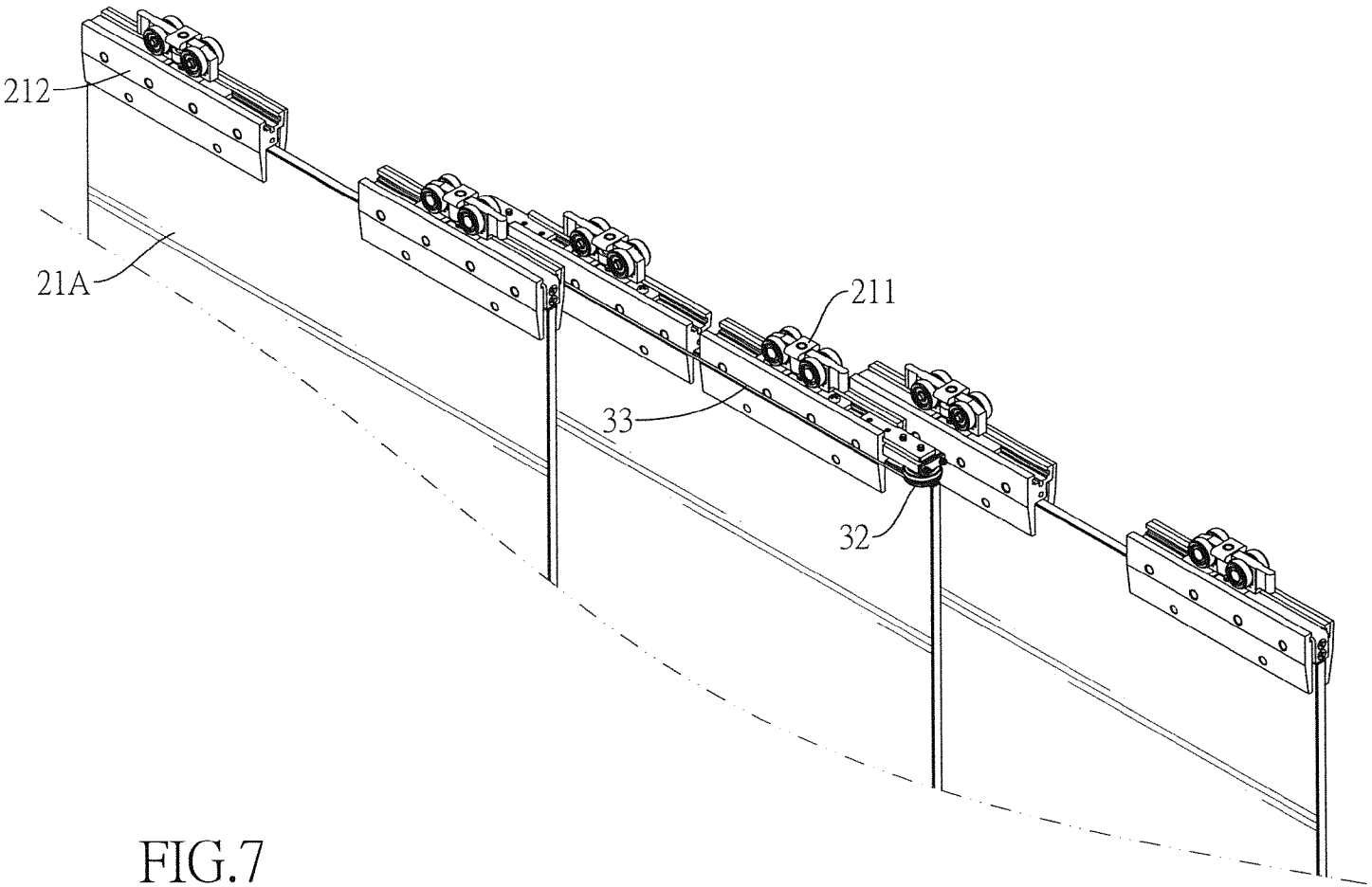
FIG. 7 is an enlarged perspective view of another embodiment of the interactive sliding-door device.
Figure 8:
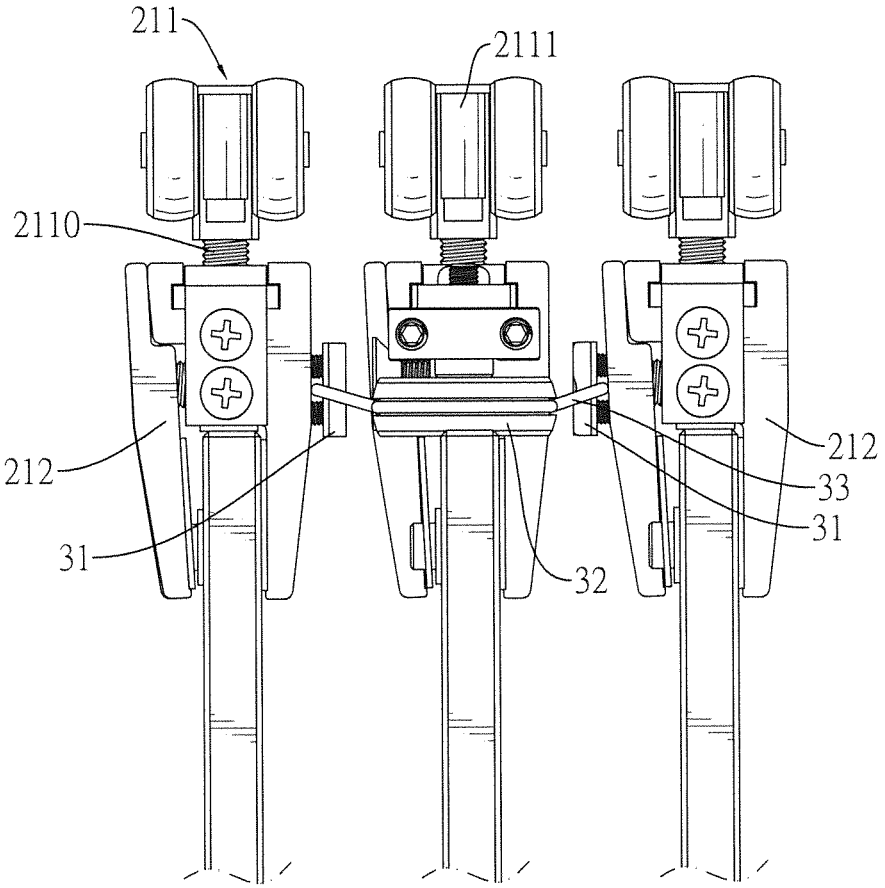
FIG. 8 is an enlarged side view of the interactive sliding-door device in FIG. 7.
Figure 9:
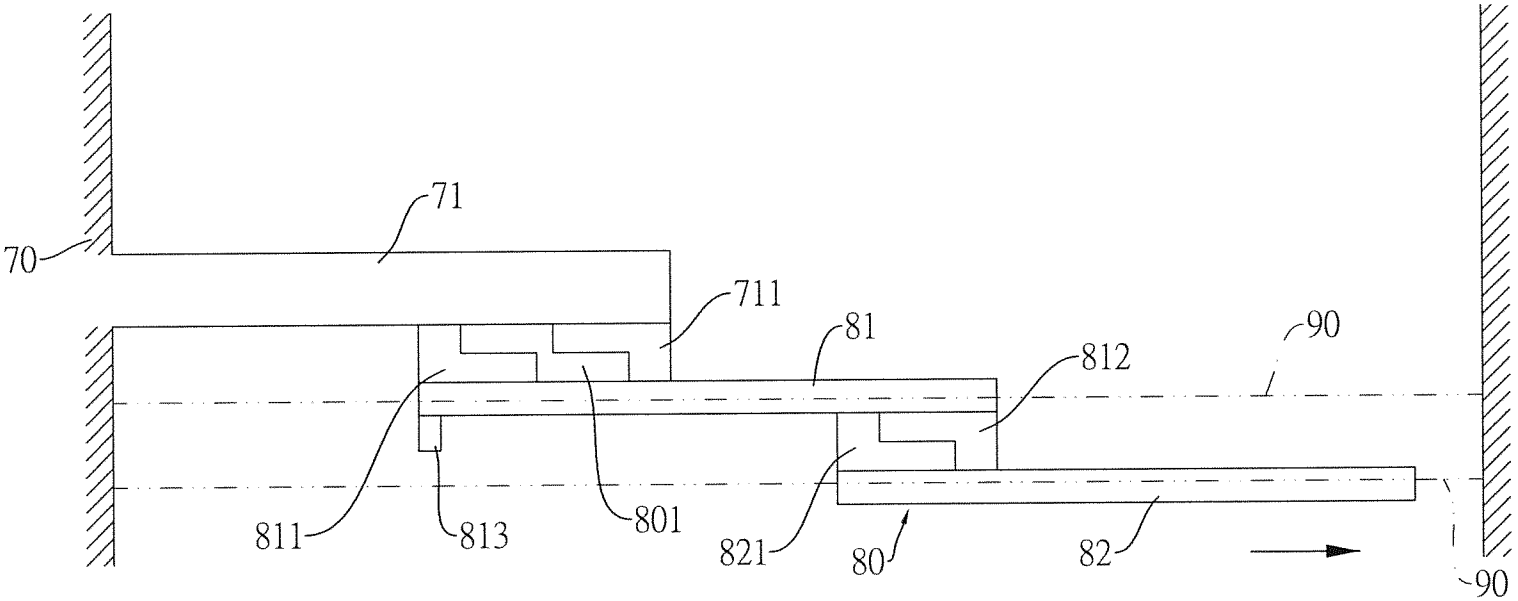
FIG. 9 is a top view of a conventional sliding door in accordance with the prior art showing that the conventional sliding door is extended.
Figure 10:
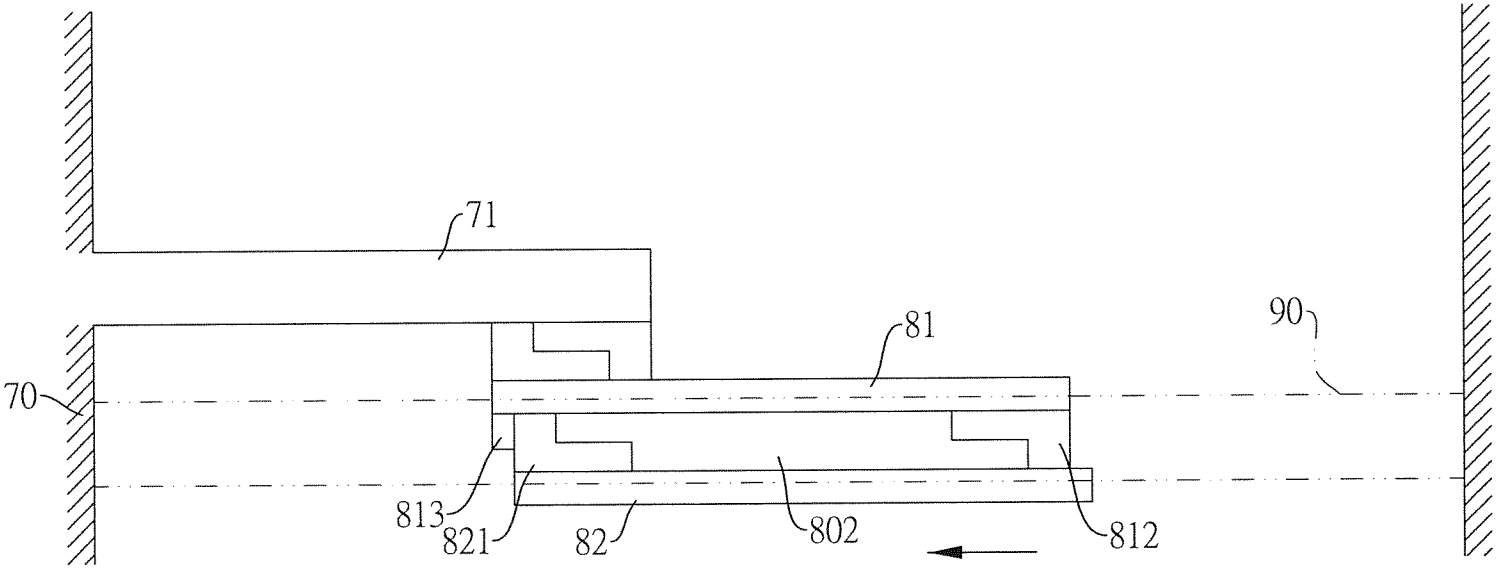
FIG. 10 is an operational top view of the conventional sliding door in FIG. 9 showing that the conventional sliding door is retracted.

In another embodiment of the present invention, with reference to FIGS. 7 and 8, a difference between the two embodiments of the present invention is that the boards 21A may be glass boards.

Each of the boards 21A further has two mounting assemblies 212. The mounting assemblies 212 are mounted respectively in two ends of the top end surface of the board 21A.

The wheel assemblies 211 are mounted on a top end surface of each of the mounting assemblies 212.

The two clamps 31 are mounted respectively in the two mounting assemblies 212 that are mounted on the boards 21A of the two outer sides of the door assembly 20. The clamps 31 are mounted on a side surface of the mounting assembly 212 that is disposed on the middle portion of the door assembly 20.

The two positioning wheels 32 are mounted respectively in two ends of a top end surface of the board 21A that is disposed in the middle portion of the door assembly 20. The cord 33 is mounted in the grooves of the two positioning wheels 32, and is clamped by the two clamps 32.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An interactive sliding-door device mounted in an inner space of a building, the interactive sliding-door device comprising:

a track assembly having multiple elongated members disposed side by side and mounted on a top end of the inner space of the building; and multiple positioning blocks arranged in pairs, and each pair of the positioning blocks mounted respectively in two ends of an inside wall of a corresponding elongated member; and a door assembly mounted slidably in the track assembly and having multiple boards disposed side by side, mounted in the elongated members respectively, and each of the boards having multiple wheel assemblies mounted slidably inside the elongated members, wherein the wheel assemblies are mounted on a top end surface of the board and are detachably mounted in the positioning blocks; and an interacting assembly mounted on the top end surface of the board of the door assembly, and connecting the boards together, wherein one of the boards is pushed or pulled to drive the other boards to slide;

wherein the multiple elongated members are three elongated members in amount, wherein two of the three elongated members are disposed on two outer sides of the track assembly, and the other one elongated member is disposed on a middle portion of the track assembly; and wherein the multiple positioning blocks are six positioning blocks in amount, wherein the positioning blocks are arranged in pairs and mounted in the elongated members respectively;

wherein a number of the boards is three, wherein two of the three boards are disposed on two outer sides of the door assembly, and the other one board is disposed on a middle portion of the door assembly; and each of the boards has two wheel assemblies mounted on the top end surface of the board, and mounted slidably inside the elongated member; and wherein the interacting assembly has two clamps mounted respectively in the two boards disposed on the two outer sides of the door assembly, and mounted respectively in one end of each of the two boards;

two positioning wheels mounted respectively on two ends of the top end surface of the board disposed on the middle portion of the door assembly, wherein each of the positioning wheels has a groove defined annually in an outer surface of the positioning wheel and being parallel to the top end surface of the board; and wherein a cord mounted in the grooves of the two positioning wheels and clamped by the two clamps.

2. The interactive sliding-door device as claimed in claim 1, wherein each elongated member has two sliding parts formed on a bottom surface of the elongated member, wherein the two sliding parts are disposed opposite each other; and a slot defined between the two sliding parts in a longitudinal direction of the elongated member; and each positioning block of the track assembly has an attaching seat mounted in an end of the elongated member; and a holding part, wherein one of two ends of the holding part attaches to the attaching seat, and the other end is U-shaped extending away from the attaching seat;

each wheel assembly of the board has a base part mounted on the top end surface of the board and having a protruding part formed on and protruding from one of two ends of the base part, and detachably mounted in the U-shaped end of the holding part of the positioning block; and two pairs of rollers mounted respectively in two side surfaces of the base part, wherein the rollers of each pair are spaced apart at an interval, and the rollers are mounted in the sliding part of the elongated member; and a bolt mounted through the slot of the elongated member and mounted in the base part by threading.

3. The interactive sliding-door device as claimed in claim 1, wherein the interacting assembly further has two sliding tracks mounted respectively on a bottom end surface of the two boards disposed on the two outer sides of the door assembly; and two sliding blocks mounted respectively on two side surfaces of a bottom end of the board disposed on the middle portion of the door assembly, the two sliding blocks attached respectively to the two sliding tracks mounted on the two boards disposed on the two outer sides of the door assembly.

4. The interactive sliding-door device as claimed in claim 3, further having two door locks mounted respectively on an outer edge of each of the two boards disposed on the two outer sides of the door assembly;

two pairs of door handles mounted respectively on two side surfaces of the two boards disposed on the two outer sides of the door assembly; and two retaining elements mounted respectively on two inner walls of the inner space of the building, and detachably connected to the two door locks respectively.

5. The interactive sliding-door device as claimed in claim 2, wherein the interacting assembly further has two sliding tracks mounted respectively in a bottom end surface of each of the two boards disposed on the two outer sides of the door assembly; and two sliding blocks mounted respectively on two side surfaces of the board disposed on the middle portion of the door assembly, the sliding blocks attached respectively to the two sliding tracks mounted on the two boards disposed on the two outer sides of the door assembly.

6. The interactive sliding-door device as claimed in claim 5, further having two door locks mounted respectively on an outer edge of each of the two boards disposed on the two outer sides of the door assembly;

two pairs of door handles mounted respectively on two side surfaces of the two boards disposed on the two outer sides of the door assembly; and two retaining elements mounted respectively on two inner walls of the inner space of the building, and detachably connected to the two door locks respectively.

7. An interactive sliding-door device mounted in an inner space of a building, the interactive sliding-door device comprising:

track assembly having multiple elongated members disposed side by side and mounted on a top end of the inner space of the building; and multiple positioning blocks arranged in pairs, and each pair of the positioning blocks mounted respectively in two ends of an inside wall of a corresponding elongated member; and a door assembly mounted slidably in the track assembly and having multiple boards disposed side by side, mounted in the elongated members respectively, and each of the boards having multiple wheel assemblies mounted slidably inside the elongated members, wherein the wheel assemblies are mounted on a top end surface of the board and are detachably mounted in the positioning blocks; and an interacting assembly mounted on the top end surface of the board of the door assembly, and connecting the boards together, wherein one of the boards is pushed or pulled to drive the other boards to slide;

wherein the multiple elongated members are three elongated members in amount, wherein two of the three elongated members are disposed on two outer sides of the track assembly, and the other one elongated member is disposed on a middle portion of the track assembly; and wherein the multiple positioning blocks are six positioning blocks in amount, wherein the positioning blocks are arranged in pairs and mounted in the elongated members respectively;

wherein a number of the boards are three, wherein two of the three boards are disposed on two outer sides of the door assembly, and the other one board is disposed on a middle portion of the door assembly, wherein each board is a glass board;

wherein each of the boards has two wheel assemblies; and two mounting assemblies mounted respectively on two ends of the top end surface of the board, wherein each wheel assembly is mounted on a top end surface of each mounting assembly;

wherein the interacting assembly has two clamps mounted respectively in the two mounting assemblies mounted on the two boards disposed on the two outer sides of the door assembly and mounted respectively in one end of each of the two boards, wherein each clamp is mounted on a side surface of the mounting assembly disposed on the middle portion of the door assembly;

wherein two positioning wheels mounted respectively on two ends of the top end surface of the board disposed on the middle portion of the door assembly, wherein each of the positioning wheels has a groove defined annually in an outer surface of the positioning wheel and being parallel to the top end surface of the board; and wherein a cord mounted in the grooves of the two positioning wheels and clamped by the two clamps.

8. The interactive sliding-door device as claimed in claim 7, wherein each of the elongated members has two sliding parts formed on a bottom surface of the elongated member, wherein the two sliding parts are disposed opposite each other; and a slot defined between the two sliding parts in a longitudinal direction of the elongated member; and each positioning block of the track assembly has an attaching seat mounted in an end of the elongated member; and a holding part, wherein one of two ends of the holding part attaches to the attaching seat, and the other end is U-shaped extending away from the attaching seat;

each wheel assembly of the board has a base part mounted on the top end surface of the board and having a protruding part formed on and protruding from one of two ends of the base part, and detachably mounted in the U-shaped end of the holding part of the positioning block;

two pairs of rollers mounted respectively in two side surfaces of the base part, wherein the rollers of each pair are spaced apart at an interval, and the rollers are mounted in the sliding part of the elongated member; and a bolt mounted through the slot of the elongated member and mounted in the base part by threading.

9. The interactive sliding-door device as claimed in claim 7, further having two sliding tracks mounted respectively on a bottom end surface of the two boards disposed on the two outer sides of the door assembly; and two sliding blocks mounted respectively on two side surfaces of a bottom end of the board disposed on the middle portion of the door assembly, the two sliding blocks attached respectively to the two sliding tracks mounted on the two boards disposed on the two outer sides of the door assembly.

10. The interactive sliding-door device as claimed in claim 9, further having two door locks mounted respectively on an outer edge of each of the two boards disposed on the two outer sides of the door assembly;

two pairs of door handles mounted respectively on two side surfaces of the two boards disposed on the two outer sides of the door assembly; and two retaining elements mounted respectively on two inner walls of the inner space of the building, and detachably connected to the two door locks respectively.

11. The interactive sliding-door device as claimed in claim 8, wherein the interacting assembly further has two sliding tracks mounted respectively on a bottom end surface of each of the two boards disposed on the two outer sides of the door assembly; and two sliding blocks mounted respectively on two side surfaces of a bottom end of the board disposed on the middle portion of the door assembly, the two sliding blocks attached respectively to the two sliding tracks mounted on the two outer boards.

12. The interactive sliding-door device as claimed in claim 11, further having two door locks mounted respectively on an outer edge of each of the two boards disposed on the two outer sides of the door assembly;

two pairs of door handles mounted respectively on two side surfaces of the two boards disposed on the two outer sides of the door assembly; and two retaining elements mounted respectively on two inner walls of the inner space of the building and detachably connected to the two door locks respectively.

* * * * *